US005368177A

United States Patent [19]

Derksen

[11] Patent Number: 5,368,177

[45] Date of Patent: Nov. 29, 1994

[54] INFUSION BOTTLE

[75] Inventor: Klaus Derksen, Karlsbad-Ittersbach, Germany

[73] Assignee: POHL GmbH & Co. KG, Karlsruhe, Germany

[21] Appl. No.: 125,985

[22] Filed: Sep. 23, 1993

[30] Foreign Application Priority Data

Sep. 23, 1992 [DE] Germany ..... 4231750

[51] Int. Cl.[5] ..... B65D 39/00

[52] U.S. Cl. ..... 215/249; 215/247; 215/251; 215/253; 215/305; 604/415

[58] Field of Search ..... 215/247, 249, 251, 253, 215/296, 297, 305, 351, 352, 355; 383/96; 220/270, 272, 273; 604/411, 415

[56] References Cited

U.S. PATENT DOCUMENTS

| | | | |
|---|---|---|---|
| 3,888,377 | 6/1975 | Stadler | 215/249 |
| 4,482,069 | 11/1984 | Stadler | 215/249 |
| 4,501,372 | 2/1985 | Hansen | 215/247 |
| 4,512,486 | 4/1985 | Kobayashi et al. | 215/251 |
| 4,844,267 | 7/1989 | von Schuckmann | 215/305 |
| 5,088,612 | 2/1992 | Storar et al. | 215/247 |

FOREIGN PATENT DOCUMENTS

| | | | |
|---|---|---|---|
| 0480196 | 4/1992 | European Pat. Off. | 604/415 |
| 4103041 | 4/1992 | Germany . | |

*Primary Examiner*—David T. Fidei
*Attorney, Agent, or Firm*—Kenyon & Kenyon

[57] ABSTRACT

An infusion bottle having a partial section of its bottom wall which bulges outward in a cup-like manner and which can be pierced in the region of its bottom wall by an infusion spike. A cup-shaped cover cap is provided which can be placed thereon from the outside and connected in liquid-tight manner. The cover cap has a cover bottom with a central region which can be removed. A clamping ring for the infusion spike is located between the cover bottom and the bottom wall of the bottle. The clamping ring is in the form of an O-ring and has an inside diameter which is smaller than the diameter of the central region. The clamping ring contacts the bottom wall of the bottle and the cover bottom with initial tension and has an outside diameter which is greater than that of the central region.

17 Claims, 5 Drawing Sheets

INFUSION BOTTLE

BACKGROUND OF THE INVENTION

The present invention relates to a plastic infusion bottle having a partial section of its bottom wall which bulges outward in the manner of a cup and which can be pierced in the region of its bottom by an infusion spike. The partial section and a cup-shaped cover cap, which can be placed thereon from the outside, are connected in liquid-tight manner. The cover cap has a cover bottom with a central region which can be removed. The cover cap also has a clamping ring for the infusion spike placed between the cover bottom and the bottom. The clamping ring is essentially an O-ring having an internal diameter which is smaller than the diameter of the central region.

Such an infusion bottle is known from German Patent No. DE-OS 41 03 041. This infusion bottle is made of polyethylene or polypropylene. An elastic lip is provided in the downward hanging mouth of the infusion bottle to allow a conical infusion spike to be fixed in position. The lip snugly surrounds the infusion spike with radial tension initially. For recycling purposes, the entire closure cap, including the lip, is produced from a uniform thermoplastic material. Such infusion bottles have unsatisfactory properties because it is difficult to obtain a sufficiently firm seat. Moreover, it is difficult to satisfactorily mount and handle the customary infusion spikes whose diameter varies within a minimum range of 4–5.6 mm. Leakages in the transition region between the clamping ring and the closure cap are frequent. The infusion solution in the infusion bottle can therefore, during the removal, pass the clamping disk in the edge region and leak past the inserted infusion spike.

There remains a need for the further development of infusion bottles of the aforementioned type that provide a proper seating and fit with respect to infusion spikes having a wide range of diameters. Moreover, there remains a need for the further development of infusion bottles of the aforementioned type that are capable of being easily recycled.

SUMMARY OF THE INVENTION

The present invention meets this need by providing an infusion bottle in which infusion spikes of all customary diameters can easily be inserted and removed, while assuring a good seal with respect to the environment and a reliable seating of the inserted infusion spike with respect to the cap covering the bottle. The invention further allows problem-free sterilization at about 100° C. and has a good recycling capability.

The present invention comprises an infusion bottle with a bottom wall which bulges outward in a cup-like manner and which can be pierced by an infusion spike. It has a cup-shaped cover cap by which is provided a liquid-tight seal. The cover cap has a central region which can be rupturedly removed to allow the introduction of an infusion spike. A clamping ring located between the infusion bottle and the cover cap provides circumferential tension to the infusion spike so that no infusion liquids may escape around the sides of the infusion spike. The clamping ring also serves to hold the infusion spike in position.

To achieve a reliable seal of the infusion bottle with respect to infusion spikes of different diameters, as well as to assure a firm seat of the inserted infusion spike, a clamping ring is provided which comprises an elastomeric material that snugly contacts the infusion bottle bottom and the cover bottom under an initial tension. The clamping ring has an outside diameter which is greater than that of the central region. In this way, the infusion liquid is prevented from emerging in the region of a cover cap past the infusion spike.

The clamping ring, which is preferably in the shape of an O-ring, comprises in one embodiment a thermoplastic elastomer material. This material has thermoplastic properties due to its polyolefin content. Thermoplastic elastomer materials can readily be processed at low cost. It can furthermore be recycled together with the infusion bottle which also consists of a polyolefin. Separation of the clamping ring and infusion bottle is not necessary after use. Due to its elastomeric content, the material has good elastic properties. The shore hardness A is 45–60. Clamping rings of softer material cannot seat the inserted infusion spike properly. Harder materials do not assure the required seal for infusion spikes having greatly varying diameters. Furthermore, clamping rings of harder materials cannot be pierced by an injection needle easily. For the present invention, clamping rings of thermoplastic elastomer materials are sufficient as long as they have a particularly small volume and a correspondingly small cross section. Such clamping rings can be produced cost-effectively. The excellent properties of the clamping rings are in part due to the fact that they are elastically widened by the inserted infusion spike. Moreover, they are at the same time compressed axially by the snug contact of the cover cap and the infusion bottle. The inherent elasticity of the clamping rings is thus supplemented and superimposed by secondary forces. Thus, sterilization of the infusion bottle is then possible without problems.

Any yielding of the clamping ring outward in the radial direction can be prevented by one or more support elements which are connected with the cover cap. These snugly contact the clamping ring before the insertion of the infusion spike at least over partial regions of the outer circumference. In the simplest case, such a support element can be formed by a sleeve-like extension on the cover cap which surrounds the clamping ring on the outside. The clamping ring, in this connection, can also be subdivided in a segment-like manner around its circumference. The degree of compression which results between clamping ring, infusion bottle, infusion spike, and cover cap can be changed by varying the circumferential extent, the circumferential distribution, and the elastic yielding in the radial direction either of the support element or of the parts forming the support element. In this way, introduction and removal of an infusion spike requires only a small amount of force but nevertheless assures a sufficiently firm and liquid-tight seat in the inserted condition. The support elements which follow each other in the circumferential direction are preferably of identical shape and arranged at uniform distances from each other.

The profile of such an extension can be provided with an undercut, similar to a holding claw. The clamping ring can snap into this undercut upon insertion.

Such support elements will, in the following, be alternatively referred to as: extensions, undercuts, or holding claws, depending upon context.

The support elements are arranged on the bottom side of the cover bottom in a radial distribution outside the central region. In this way, when the central region has been torn out and the infusion spike inserted into the clamping ring, the clamping ring may be reliably supported with sealing tension between cover bottom, bottom, and support elements.

The cover bottom can be integral with the support elements which results in a simple assembly and seating of the functioning cover cap on the infusion bottle. Separate attachment and assembly of several parts, as well as their precise positioning, can be eliminated.

In addition to an essentially circular cross section, the clamping ring can be provided with recesses arranged spacedly on the circumference. This allows support elements such as holding claws to be snapped around the clamping ring. The holding claws can have an essentially L-shaped profile and can engage behind the clamping ring. The clamping ring is pressed in sealing manner against the cover bottom with radial initial tension and with axial initial tension. The bottle can be sterilized using temperatures in excess of 100° C. without impairment of the sealing of the cover cap by the clamping ring. Due to the initial tension of the clamping ring, which is arranged between the bottom and the cover bottom and seals off the bottom from the environment, good properties in the use of the infusion bottle are assured.

In accordance with another embodiment, the central region can have an essentially circular central projection integrally formed thereon which projects in the direction of the bottom and which is surrounded in sealing manner by the inner circumference of the clamping ring. This allows partial removal of the liquid from the bottle. The user can then close the bottle again, in liquid-tight manner, using the closure. Any unintended leakage of residual liquid can thereby be avoided. In order to achieve good automatic locking, the central projection should be of cylindrical shape where it contacts the clamping ring. To facilitate insertion, the protruding end can have a uniformly tapered diameter.

For simple manufacture and easy handling of the cover cap, the central region can be provided with an opening tab integrally formed thereon.

On the side facing away from the clamping ring, the central region can have a depression which can engage a projection arranged on the cover bottom. It is advantageous to be able to snap the projection to the depression after the removal of the central region. Cumbersome intermediate storage of the central region, which has been removed from the cover bottom, as well as its separate disposal, can thus be eliminated. The infusion bottle, cover cap, and central region can, after use, be disposed of or recycled together.

The clamping ring surrounds the infusion spike. The infusion spike uses radial initial tension around the circumference to make a seal. The frictional resistance is increased upon insertion such that any existing impurities are reliably wiped off the outer circumference of the infusion spike by the clamping ring and therefore do not pass into the infusion liquid being administered to the patient.

The clamping ring can be plate-like and placed in the central region of the bottom with a weakened area. This allows the insertion of an injection needle in order to make it possible, even with the infusion spike already inserted, to add additional drugs to the liquid present in the infusion bottle.

BRIEF DESCRIPTION OF THE DRAWINGS

The infusion bottle constructed according to the principle of the invention will be explained further below with reference to the accompanying drawings, in which.

DETAILED DESCRIPTION

Figure 1:
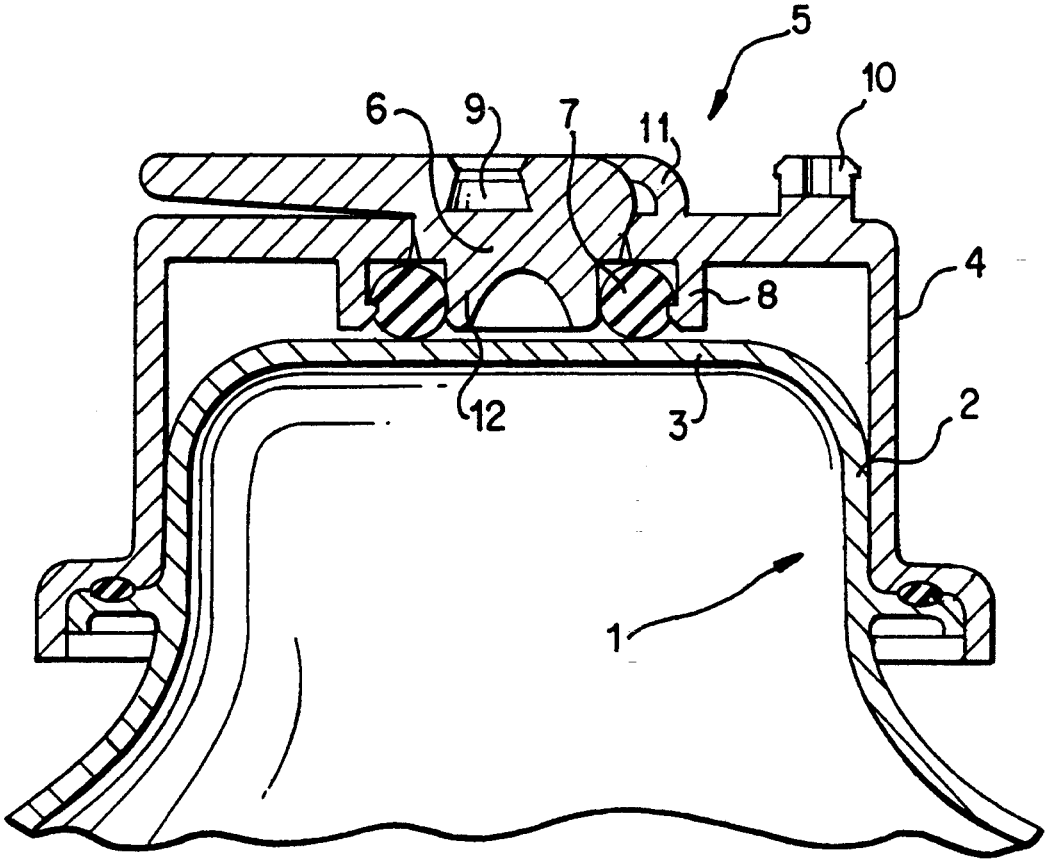
FIG. 1 is a sectional view of the infusion bottle in the region of the mouth of the bottle.

FIG. 1 is a sectional view of infusion bottle 1 according to the invention. The bottle has in the region of the bottleneck a thin wall 2 which can be pierced by an infusion spike in the region of bottom 3 of infusion bottle 1. Cup-shaped cover cap 4 is placed on the bottleneck and connected in liquid-tight manner with infusion bottle 1, for instance, by welding them to each other. Cover cap 4 is formed by cover bottom 5 having a central region 6 which can be torn out and which must be removed before the introduction of the infusion spike. Central region 6 is provided for this purpose with an opening tab integrally formed thereon and consists of polypropylene in the same manner as infusion bottle 1 and cover cap 4.

Between cover bottom 5 of cover cap 4 and bottom 3 of infusion bottle 1, there is arranged clamping ring 7 which has the shape of an O-ring. Clamping ring 7 is made of a thermoplastically processible rubber and surrounds the infusion spike after its introduction into infusion bottle 1 with radial initial tension in the region of its inner circumference in sealing and self-locking manner. Clamping ring 7 is elastically widened by the inserted infusion spike and is compressed axially by the snug contact of cover cap 4 through support elements to be described. Clamping ring 7 thus serves both to secure the infusion spike against unintentional removal from infusion bottle 1 and serves at the same time to seal off infusion bottle 1 and cover cap 4. Clamping ring 7 contacts bottom 3 and cover bottom 5 with radial and axial initial compression and seals off at least cover bottom 5 from the infusion spike. Thus the infusion liquid can leave infusion bottle 1 only through the infusion spike introduced. Clamping ring 7 is held in position by support elements. In this embodiment, these support elements are holding claws 8 which are integrally formed on cover bottom 5 and which protrude in the direction of bottom 3. They are distributed uniformly in a circumferential direction over the course of an imaginary ring. Holding claws 8 surround clamping ring 7 along their inner circumference. Clamping ring 7 can be provided with recesses 13, as shown in FIG. 2*a*. These can be spaced around the circumference, and allow holding claws to be more easily snapped around the clamping ring.

Central region 6 has a generally circular central projection 12 which is integrally formed thereon that protrudes in the direction of bottom 3. In the embodiment shown, central projection 12 is surrounded in sealing manner by the inner circumference of clamping ring 7 and is of cylindrical shape in the region of the zone of contact with clamping ring 7.

On its side facing away from infusion bottle 1, cover cap 4 has projection 10 in the region of cover bottom 5 into which projection depression 9 of central region 6 can be snapped and fixed after the removal and bending back of central region 6 about living hinge 11. After tearing out central region 6, the user need not take steps to separately dispose of it. The infusion spike can be immediately introduced into infusion bottle 1 through clamping ring 7. The puncture region for the infusion spike is completely exposed and is no longer covered even partially by torn out central region 6. The operating steps are then transparent and can be performed quickly. This counteracts any contamination of bottom 3 in the region of the puncture after central region 6 is removed. The removal of the infusion liquid can be interrupted by removal of the infusion spike and subsequent bending back of central region 6 into the position shown in FIG. 1. In this case, central projection 12 again comes into sealing engagement with clamping ring 7 whereby infusion bottle 1 is hermetically closed. Any unintended loss of liquid during the disposal of the still partially filled infusion bottle 1 is thus made more difficult.

Figure 2:
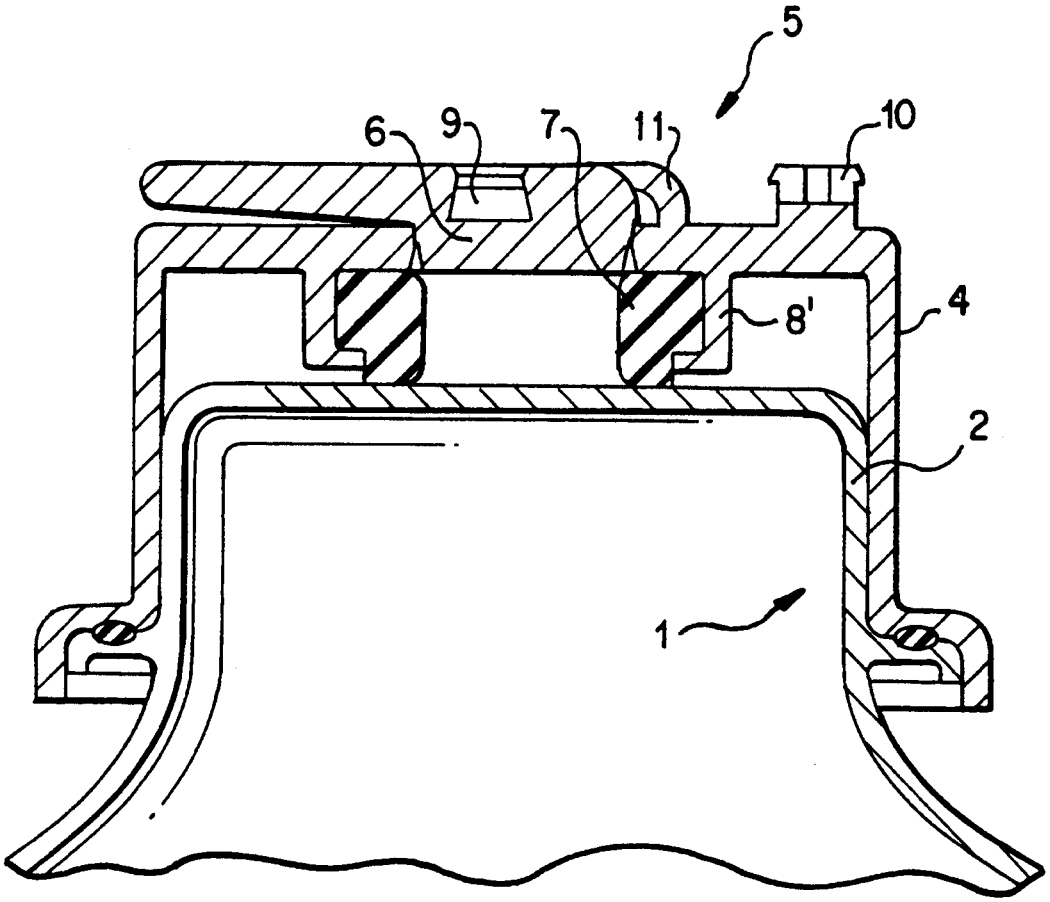
FIG. 2 is a sectional view of a cover cap shown in longitudinal section, the clamping ring and the holding claws being developed differently from those shown in FIG. 1.
Figure 2A:
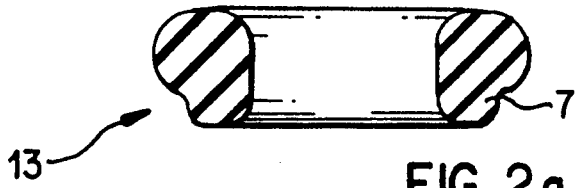
FIG. 2*a* is a sectional view of a clamping ring showing recesses.

FIG. 2 shows an embodiment of an infusion bottle of plastic which differs from FIG. 1. The differences with respect to infusion bottle 1 of FIG. 1 reside, in particular, in the region of support elements or holding claws 8' and clamping ring 7. Support elements or holding claws 8' have a substantially L-shaped profile and engage below clamping ring 7 with an extension which protrudes radially in the direction of central region 6. Clamping ring 7 can be snapped into the axial projections so that its position in the radial and axial directions, referred to central region 6, is well-fixed.

Figure 3A:
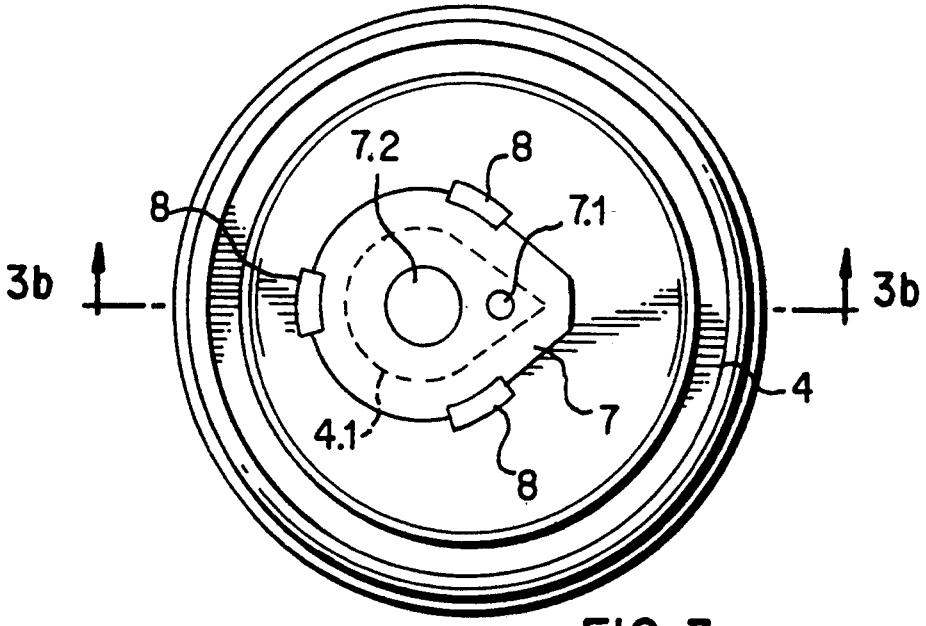
FIG. 3*a* is a bottom plan view of a cover cap in which the clamping ring and the cover cap are so developed that an injection needle can be introduced into the infusion bottle near the infusion spike.
Figure 3B:
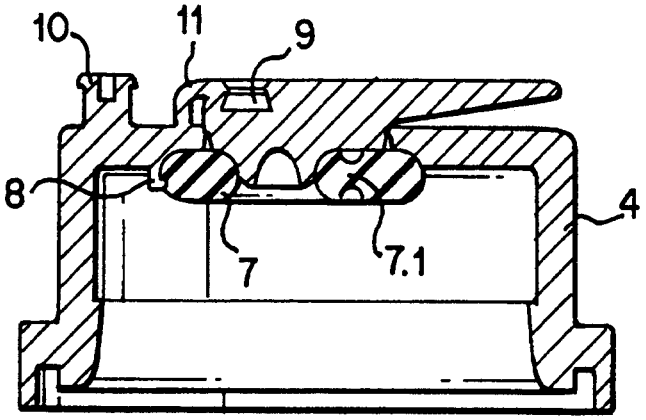
FIG. 3*b* is a longitudinal section through the cover cap of FIG. 3*a* taken along line A—A.

FIGS. 3*a* and 3*b* show a cover cap similar to FIGS. 1 and 2 in bottom view and in longitudinal section, respectively. They illustrate the plate-like development of clamping ring 7 having an extension protruding towards the right. The extension has in the protruding region a weakened area 7.1 at which it can be pierced by an injection needle. Cover cap 4 has a generally flexible area, outlined by dashed line 4.1 in FIG. 3*a*. It surrounds weakened area 7.1 and infusion spike passage opening 7.2 at a radial distance. The area outlined by dashed line 4.1 is covered prior to use by central region 6 of cover bottom 5. After the removal of central region 6, its subsequent bending back about living hinge 11, and the snapping of central region 6 with its depression 9 onto projection 10 of cover cap 4, infusion spike passage opening 7.2 and weakened area 7.1 are completely exposed. The infusion spike can be introduced, whereby clamping ring 7 surrounds the infusion spike in non-detachable and sealing manner. At the same time, the addition of a drug to the infusion liquid contained in the infusion bottle by means of an injection needle is possible in the region of weakened area 7.1.

Figure 4A:
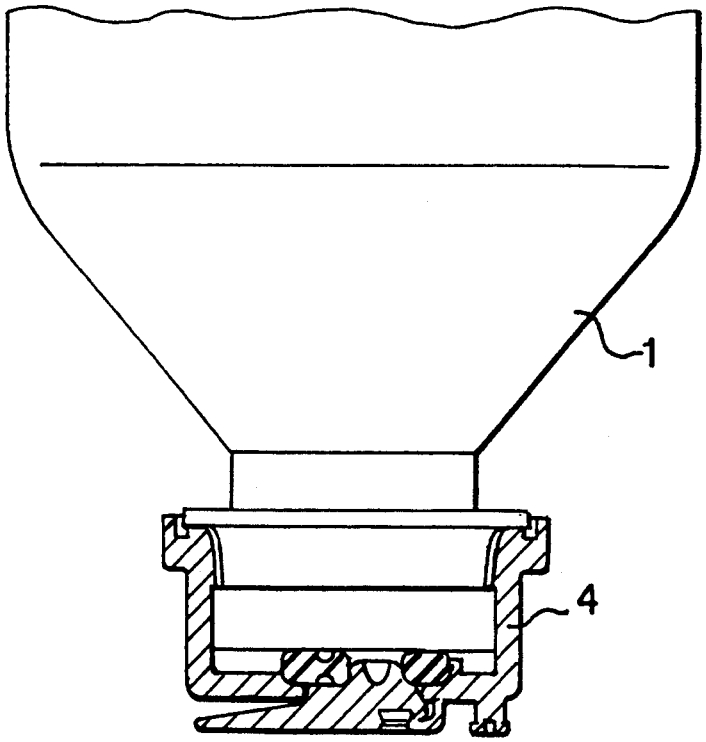
FIG. 4*a* shows the cover cap of FIG. 3*a* after it has been combined with an infusion bottle.

FIG. 4*a* shows cover cap 4 after it has been combined with infusion bottle 1. Infusion bottle 1 is shown, in this embodiment, in a side view and cover cap 4 in longitudinal section.

Figure 4B:
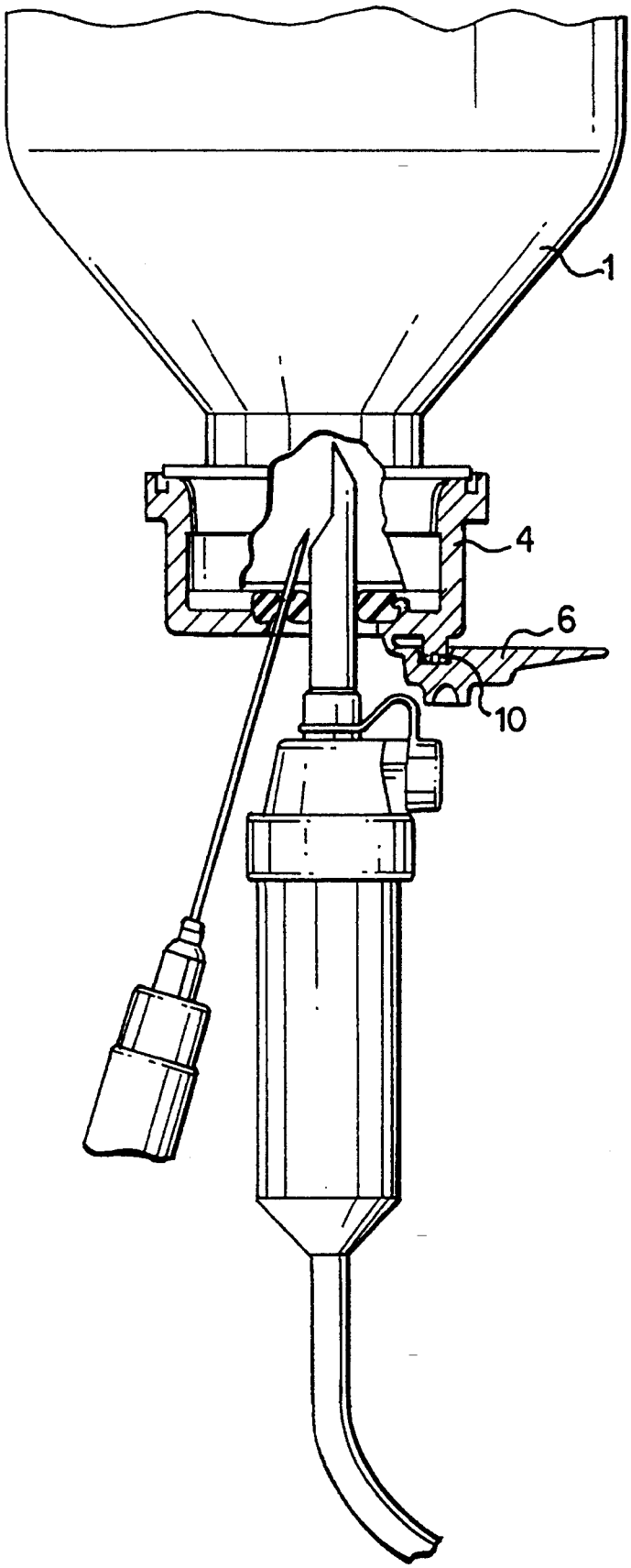
FIG. 4*b* shows the infusion bottle during its intended use, the cover cap being shown in longitudinal section.

FIG. 4*b* illustrates the use of cover cap 4 during the intended use of infusion bottle 1. Infusion bottle 1 is here suspended upside down on a gallows (not shown). Central region 6 has been broken out of cover bottom 5 along a circumferential continuous weakened line and swung back about living hinge 11 and snapped onto projection 10. Clamping ring 7 is thus freely accessible from below. It surrounds an infusion spike which has been introduced into infusion bottle 1, sealing it circumferentially. The liquid contained in infusion bottle 1 can thus be removed continuously and used for patient care. Left of the infusion spike is shown an injection needle which pierces clamping ring 7 at weakened area 7.1 and terminates in infusion bottle 1. By means of the injection needle, the infusion liquid can be enriched with a drug in any desired dose. When the injection needle is removed from the place of puncture, the place of puncture is immediately closed automatically due to the elasticity of the material forming clamping ring 7. Any contamination of the environment and penetration of harmful substances or germs into infusion bottle 1 can thus be prevented.

What is claimed is:

1. An infusion bottle, comprising:

a bottle with a bottom wall, said bottom wall bulging outward, such that said bottom wall can be pierced by an infusion spike;

a cup-shaped cover cap, such that said cover cap can be attached to said bottle in a liquid-tight manner, said cover cap comprising a cover bottom;

a central region in the center of said cover bottom, said central region being capable of rupture with respect to said cover bottom;

an opening tab connected integrally with said central region, whereby said opening tab is used to tear out said central region from said cover bottom;

a depression located within said central region on the side facing away from said bottle and a projection located within said cover bottom on the side facing away from said bottle, such that when said central region is torn out and bent back, said depression and said projection can be lockingly engaged; and an elastomeric clamping ring having an inside diameter that is less than that of said central region of said cover bottom and an outside diameter that is greater than that of said central region of said cover bottom;

said clamping ring being located between said cover bottom and said bottom wall of said bottle and contacting each of said cover bottom and said bottom wall of said bottle with initial elastic axial compression, such that said clamping ring can be used to hold and seal an inserted infusion spike.

2. The infusion bottle of claim 1, wherein said cover bottom further comprises at least one support element so that said at least one support element are distributed circumferentially to hold in position said clamping ring.

3. The infusion bottle of claim 2, wherein said at least one support element is constructed integral with said cover bottom.

4. The infusion bottle of claim 2, wherein said clamping ring has recesses for engaging said at least one support element.

5. The infusion bottle of claim 1, wherein when said central region is torn out and bent back, said depression and said projection can be engaged using snap-fastening.

6. The infusion bottle of claim 1, wherein said clamping ring can be pierced by an injection needle.

7. The infusion bottle of claim 6, wherein said clamping ring has a thickness at the place of puncture of an injection needle which is less than that of the remainder of said clamping ring.

8. The infusion bottle as in one of claims 1 through 4 or 5 through 7, wherein said elastomeric material is one of thermoplastically processible rubber and thermoplastic elastomer material.

9. The infusion bottle of claim 1, wherein said elastomeric material has a shore hardness A within a range of 45–60.

10. The infusion bottle of claim 1, wherein said clamping ring surrounds and contacts an inserted infusion spike with radial tension.

11. The infusion bottle of claim 1, wherein said elastomeric material is a thermoplastic elastomer material containing a polyolefin.

12. An infusion bottle, comprising:

a bottle with a bottom wall, said bottom wall capable of being pierced by an infusion spike;

a cover cap, such that said cover cap can be attached to said bottle in a liquid-tight manner, said cover cap comprising:

a cover bottom;

a central region in the center of said cover bottom, said central region being capable of rupture with respect to said cover bottom;

an integral living hinge placed integral with and between said central region and said cover bottom, said living hinge connecting said central region to said cover bottom after said central region is ruptured with respect to said cover bottom;

a tab connected integrally to said central region and said living hinge, said tab capable of being used to lift and rupture said central region with respect to said cover bottom;

at least one support element depending from said cover bottom in the direction of said bottom wall of said bottle;

an elastomeric clamping ring having an inside diameter that is less than that of said central region of said cover bottom and an outside diameter that is greater than that of said central region of said cover bottom; and a cylindrical projection attached to said central region, said cylindrical projection protruding at least partially into said clamping ring;

said clamping ring being located between said cover bottom and said bottom wall of said bottle and contacting each of said cover bottom and said bottom wall of said bottle with initial elastic axial compression, said clamping ring being held in place by said at least one support element, such that said clamping ring can be used to hold and seal an inserted infusion spike.

13. The infusion bottle of claim 12, wherein said at least one support element is a holding claw distributed circumferentially to hold in position said clamping ring.

14. The infusion bottle of claim 12, wherein said clamping ring has recesses for engaging said at least one support element.

15. The infusion bottle of claim 12, further comprising:

a depression located within said central region on the side facing away from said bottle; and a projection located within said cover bottom on the side facing away from said bottle, such that when said central region is torn out and bent back, said depression and said projection can be lockingly engaged.

16. The infusion bottle of claim 12, wherein said clamping ring can be pierced by an injection needle.

17. The infusion bottle of claim 12, wherein said clamping ring has a thickness at the place of puncture of an injection needle which is less than that of the remainder of said clamping ring.

* * * * *